US005875742A

United States Patent [19]

Moroi et al.

[11] Patent Number: 5,875,742

[45] Date of Patent: Mar. 2, 1999

[54] VISCOUS FLUID TYPE HEAT GENERATOR WITH MEANS FOR MAINTAINING RELIABLE HEAT-GENERATING-PERFORMANCE

[75] Inventors: Takahiro Moroi; Takashi Ban; Shigeru Suzuki; Kiyoshi Yagi, all of Kariya, Japan

[73] Assignee: Kabushiki Kaisha Toyoda, Kariya, Japan

[21] Appl. No.: 62,849

[22] Filed: Apr. 20, 1998

[30] Foreign Application Priority Data

Apr. 21, 1997 [JP] Japan ..... 9-103026

[51] Int. Cl.[6] ..... F22B 3/06

[52] U.S. Cl. ..... 122/26; 237/12.3 R; 126/247

[58] Field of Search ..... 122/26, 27; 123/142.5 R; 126/247; 237/12.3 R, 12.3 B

[56] References Cited

U.S. PATENT DOCUMENTS 4,733,635 3/1988 Menard et al. ..... 122/26
4,974,778 12/1990 Bertling .
5,788,151 8/1998 Moroi et al. ..... 122/26

FOREIGN PATENT DOCUMENTS 0687584 12/1995 European Pat. Off. .
A398107 10/1991 Japan .

*Primary Examiner*—Teresa Walberg
*Assistant Examiner*—Gregory Wilson
*Attorney, Agent, or Firm*—Burgess, Ryan & Wayne

[57] ABSTRACT

A viscous fluid type heat generator having a sealed heat generating chamber in which heat generation in the viscous fluid is carried out in response to the rotation of a rotor element received in the heat generating chamber and applying a shearing action to the viscous fluid, the sealed heat generating chamber having front and rear heat generating chamber portions on both sides of the rotor element and a large annular gap extending between the front and rear heat generating chamber portions and surrounding the rotor element to provide a fluid communication between the front and rear heat generating chamber portions in order to prevent the viscous fluid in the first and second heat generating portions from being unequally degraded.

16 Claims, 6 Drawing Sheets

VISCOUS FLUID TYPE HEAT GENERATOR WITH MEANS FOR MAINTAINING RELIABLE HEAT-GENERATING-PERFORMANCE

BACKGROUND OF THE INVENTION

1. Field of the Invention

The present invention generally relates to a viscous fluid type heat generator in which heat is generated by forcibly shearing a viscous fluid confined in a chamber and the heat is transmitted to a heat exchanging liquid circulating through a heating system. More particularly, the present invention relates to a viscous fluid type heat generator used as a heat source, for supplying heat to a heating system, provided with an ability to maintain a reliable heat-generating performance during the operation of the heating system.

2. Description of the Related Art

Japanese Unexamined (Kokai) Utility Model Publication No. 3-98107 (JU-A-3-98107) discloses a viscous fluid type heat generator adapted for being incorporated into an automobile heating system as a supplemental heat source. The viscous fluid type heat generator of JU-A-3-98107 is formed as a heat generator provided with a unit for changing a heat-generating performance. The heat generator of JU-A-3-98107 includes front and rear housings connected together to form a housing assembly in which a heat generating chamber, for holding a viscous fluid, and a heat receiving chamber, arranged adjacent to the heat generating chamber to allow a heat exchanging liquid to receive heat from the heat generating chamber, are formed. The heat receiving chamber in the housing assembly allows the heat exchanging liquid to flow therethrough from a liquid inlet port to a liquid outlet port formed in a portion of the housing assembly. Namely, the heat exchanging liquid is circulated through the heat receiving chamber and a separate heating circuit of the automobile heating system so as to supply heat to the objective area, e.g., a passenger compartment of the automobile, during the operation of the heating system. The heat exchanging liquid flows into and out of the heat receiving chamber through the liquid inlet port and the liquid outlet port. The heat generator of JU-A-3-98107 further includes a drive shaft rotatably supported by bearings which are seated in the front and rear housings of the housing assembly. A rotor element is mounted on the drive shaft so as to be rotated together with the drive shaft within the heat generating chamber. The inner wall surface of the heat generating chamber and the outer surfaces of the rotor element define labyrinth grooves in which the viscous fluid, such as silicone oil having a chain-molecular structure, is sheared to generate heat, in response to the rotation of the rotor element.

The heat generator of JU-A-3-98107 has a characteristic arrangement such that upper and lower housings are attached to a bottom portion of the housing assembly to form a heat generation control chamber therein. The heat generation control chamber is formed as a volume-variable chamber having a wall consisting of a membrane such as a diaphragm.

The heat generating chamber communicates with the atmosphere via a through-hole bored in an upper portion of the front and rear housings of the housing assembly and with the heat generation control chamber via a communicating channel arranged between the heat generation control chamber and the heat generating chamber. The volume of the heat generation control chamber is adjustably changed by the movement of the diaphragm which is caused by a spring element having a predetermined spring factor or an externally supplied signal such as a pressure signal supplied from an engine manifold of an automobile.

When the drive shaft of the heat generator of JU-A-3-98107 incorporated in an automobile heating system is driven by an automobile engine, the rotor element is rotated within the heat generating chamber, so that heat is generated by the viscous fluid, to which a shearing force is applied, between the inner wall surface of the heat generating chamber and the outer surfaces of the rotor element. The heat generated by the viscous fluid is transmitted from the heat generating chamber to the heat exchanging liquid, i.e., engine-cooling water circulating through the heating system and carried by the water to a heating circuit of the heating system to warm an objective heated area such as a passenger compartment.

When it is detected that the objective area is excessively heated with respect to a reference temperature value predetermined for that area, through the detection of the temperature of the viscous fluid, the diaphragm of the heat generation control chamber is moved in response to a vacuum pressure signal supplied from the engine manifold to increase the volume of the heat generation control chamber. Accordingly, the viscous fluid is withdrawn from the heat generating chamber into the heat generation control chamber to reduce the generation of heat by the viscous fluid between the inner wall surface of the heat generating chamber and the outer surfaces of the rotor element. Therefore, the heat generating performance can be reduced, i.e., the application of heat to the objective heated area is reduced.

When it is detected that heating of the objective heated area is excessively low with respect to the predetermined reference temperature value, through the detection of the temperature of the viscous fluid, the diaphragm of the heat generation control chamber is moved by the pressure signal and by the spring force of the spring element to reduce the volume of the heat generation control chamber. Therefore, the viscous fluid contained in the heat generation control chamber is supplied into the heat generating chamber so as to increase the heat generation by the viscous fluid between the inner wall surface of the heat generating chamber and the outer surfaces of the rotor element. As a result, the heat generating performance can be increased, i.e., application of heat to the objective heated area is increased.

Nevertheless, in the viscous fluid type heat generator having a variable heat generating performance and disclosed in JU-A-3-98107, when the viscous fluid is withdrawn from the heat generating chamber into the heat generation control chamber, the atmospheric air is introduced from the through-hole of the housing assembly into the heat generating chamber so as to prevent a vacuum occurring in the heat generating chamber due to the withdrawal of the viscous fluid therefrom. Thus, the viscous fluid must come into contact with the atmospheric air when a change in the heat generating performance occurs, and is eventually oxidized. Therefore, a gradual degradation of the heat generating characteristics of the viscous fluid occurs. Further, the above-mentioned through-hole formed in the housing assembly permits a certain amount of moisture from the atmosphere to enter into the heat generating chamber of the heat generator, and accordingly, the heat generating performance of the heat generator is adversely affected by the moisture within the heat generating chamber.

Further, the viscous fluid type heat generator of JU-A-3-98107 is not internally provided with a mechanism or a means for conducting an appropriate replacement of the viscous fluid between the heat generating chamber and the heat generation control chamber. Thus, when the drive shaft is continuously rotated at a high speed without withdrawing the viscous fluid from the heat generating chamber into the heat generating control chamber, the viscous fluid confined in the heat generating chamber is continuously subjected to a shearing action by the rotor element to be heated to an extremely high temperature at which the physical property of the viscous fluid is degraded to reduce its heat generation performance.

U.S. Pat. No. 4,974,778, and the corresponding German laid-open publication DE-3832966, disclose a different type of heating system, for a vehicle with a liquid-cooled internal combustion engine, which includes a viscous fluid type heating unit. The viscous fluid type heating unit of U.S. Pat. No. '778 includes a housing defining a heat generating chamber or a working chamber having a through-opening, and a heat generation control chamber or a viscous fluid supply chamber communicating with the heat generating chamber via the through-opening. The heat generating chamber and the heat generation control chamber are not formed as chambers directly opening toward the atmosphere and, therefore, degradation of the viscous fluid due to the air and an adverse affect on the heat generating performance due to the moisture can be avoided. Further, the through-opening between the heat generating chamber and the heat generation control chamber is closed and opened by a spring-operated closing means, and accordingly, the degradation of the viscous fluid can be avoided even after long use of the heating unit or after high speed continuous operation of the heating unit.

The rotor element of the heating unit of U.S. Pat. No. '778 is formed as a wheel with a cup-shaped cross-section. Thus, the axial length of the rotor element is relatively large and increases the entire axial length of the heating unit. As a result, the mounting of the viscous fluid type heating unit in a vehicle at a position suitable for receiving a drive power from the vehicle internal combustion engine may be difficult.

European Patent Publication No. 0687584 A1 (EP-A-'058 A1) discloses a fluid-frictional type heat generator in which a disc-shape rotor element is rotated in a tightly closed and viscous fluid-filled heat generating chamber. The disc-shaped rotor element is provided with front and rear main end faces to provide the viscous fluid with a shearing action to frictionally generate heat, and the axial length of the rotor element is relatively small. Therefore, the mounting of the fluid-frictional type heat generator of EP-A-'584 A1 in a vehicle can be easy. Further, the heat generating chamber of EP-A-'584 A1 is tightly closed against the atmosphere, and accordingly, the viscous fluid in the heat generating chamber is not exposed to the fresh air, and the heat generating chamber does not permit any moisture to enter therein. Therefore, degradation of the viscous fluid does not occur, and the heat generating performance of the heat generator is not adversely affected by the moisture.

Nevertheless, in the fluid-frictional type heat generator of EP-A-'584 A1, heat generating gaps filled with the viscous fluid are formed between the opposite flat end faces of the disc-shape rotor element and the facing flat inner wall faces of the heat generating chamber, and between the outer circumference of the rotor element and the facing circular inner wall face of the heat generating chamber. Therefore, the heat generating gaps on both sides of the rotor element, i.e., a front heat generating gap and a rear heat generating gap can communicate with one another only via the heat generating chamber annularly extending around the outer circumference of the rotor element, i.e., an annular heat generating gap and, accordingly, the viscous fluid in the front heat generating gap on the front side of the rotor element is not permitted to flow toward the rear heat generating gap on the other rear side of the rotor element due to the existence of the small annular heat generating gap between the front and rear heat generating gaps. Consequently, even if the viscous fluid in each of the front and rear flat heat generating gaps of the heat generating chamber individually moves in its own heat generating gap, there occurs no fluid circulation between the heat generating gaps on both sides of the rotor element. Therefore, the viscous fluid in the heat generating chamber must gradually be degraded during the operation of the heat generator. Moreover, if the amounts of the viscous fluid in the front and rear heat generating gaps in the heat generating chamber are different from one another, degradation of the smaller amount of viscous fluid occurs more quickly than that of the larger amount of viscous fluid, and accordingly, the heat generator cannot exhibit a stable heat generating efficiency over a long operating life.

SUMMARY OF THE INVENTION

Accordingly, an object of the present invention is to provide a viscous fluid type heat generator which can obviate the above-described various defects encountered by the conventional viscous fluid type heat generator.

Another object of the present invention is to provide a viscous fluid type heat generator having an improved internal construction capable of preventing the viscous fluid held in all portions in the heat generating chamber from being unequally degraded during the long operating life of the heat generator.

A further object of the present invention is to provide a viscous fluid type heat generator with an ability of exhibiting a stable heat generating efficiency over a long operating life of the heat generator.

In accordance with the present invention, there is provided a viscous fluid type heat generator which comprises:

a housing assembly defining therein a heat generating chamber in which heat is generated, and a heat receiving chamber arranged adjacent to the heat generating chamber to permit a heat exchanging fluid to circulate therethrough to thereby receive heat from the heat generating chamber, the heat generating chamber having an inner wall surface thereof;

a drive shaft supported by the housing assembly, via bearing means, to be rotatable about an axis of rotation thereof, the drive shaft being operatively connected to an external rotation-drive source;

a rotor element mounted to be rotationally driven by the drive shaft for rotation together therewith about the axis of rotation of the drive shaft within the heat generating chamber, the rotor element having first and second outer faces axially opposite to one another and a third outer face extending between the first and second outer faces, the first and second outer faces axially confronting the inner wall surface of the heat generating chamber via first and second predetermined fluid filled gaps;

a viscous fluid, filling at least the first and second predetermined fluid filled gaps between the inner wall surface of the heat generating chamber and the first and second outer faces of the rotor element, for heat generation during the rotation of the rotor element, wherein the heat generating chamber of the housing assembly is formed as a chamber, with a predetermine volume, sealed from the atmosphere and having a central region receiving therein the rotor element and an outer region extending around the central region to define, between the third outer face of the rotor element and the inner wall face of the heat generating chamber, a communicating gap which is larger than each of the predetermined first and second fluid filled gaps and provides a fluid communication between the predetermined first and second fluid filled gaps defined by the first and second outer faces of the rotor element and the inner wall surface of the heat generating chamber.

Since the above-described heat generating chamber of the housing assembly is sealed from the atmosphere, the viscous fluid within the heat generating chamber does not come in contact with fresh air and moisture. Thus, a rapid degradation of the viscous fluid can be prevented.

Further, since the communicating gap defined by the third outer face of the rotor element and the inner wall surface of the heat generating chamber can constantly provide a fluid communication between the predetermined first and second fluid filled gaps defined between the first and the second outer faces of the rotor element and the inner wall surface of the heat generating chamber, the fluid communicating gap permits the viscous fluid held in the first and second predetermined fluid filled gaps to flow therethrough, so that the viscous fluid held in the first predetermined fluid filled gap between the first outer face of the rotor element and the inner wall surface of the heat generating chamber is permitted to enter the predetermined second fluid filled gap between the second outer face of the rotor element and the inner wall surface of the heat generating chamber and vice versa.

The communicating gap is arranged in the outer region in the heat generating chamber where a large amount of circulatory movement of the viscous fluid occurs due to the rotation of the rotor element, and a pressure level prevailing in the communicating gap is large compared with a pressure level prevailing in the central region of the heat generating chamber. Therefore, an amount of flow of the viscous fluid across the rotor element and through the communicating gap is increased when a centrifugal force acting on the viscous fluid is increased due to an increase in the rotating speed of the drive shaft and the rotor element. Accordingly, when a circulatory movement of the viscous fluid occurs in each of the first and second predetermined fluid filled gaps in the heat generating chamber in response to the rotation of the rotor element, replacement of the viscous fluid between the first and second predetermined fluid filled gaps across the rotor element can occur through the communicating gap. Thus, even if an amount of the viscous fluid held in one of the predetermined first and second fluid filling gaps is different from that held in the other of the predetermined first and second fluid filled gaps, any difference in degradation of the viscous fluid between the predetermined first and second fluid filled gap is sufficiently reduced. As a result, the viscous fluid type heat generator can exhibit a stable heat generating efficiency during the long operating life thereof.

Preferably, the housing assembly further defines a fluid receiving chamber sealed against the atmosphere and fluidly communicating with the heat generating chamber via a fluid withdrawing passage means and a fluid supplying passage means, the sealed fluid receiving chamber having a capacity suitable for receiving a predetermined volume of viscous fluid which is larger than an entire volume of the first and second predetermined fluid filled gaps defined by the first and second outer faces of said rotor element and the inner wall surface of the heat generating chamber.

Preferably, the fluid withdrawing passage means and the fluid supplying passage means are arranged to provide a constant fluid communication between the heat generating chamber and the fluid receiving chamber.

Alternatively, at least one of the fluid withdrawing passage means and the fluid supplying passage means may be provided with an open end opened and closed by a valve means, which may be comprised of a thermo-sensitive flap valve means arranged in the fluid receiving chamber.

Preferably, the fluid supplying passage means includes a rear fluid supplying recess formed in a rear inner wall surface portion of the heat generating chamber, and arranged to radially extend from a central region to an outer region of the rear inner wall surface portion so as to communicate with the communicating gap in the heat generating chamber.

Advantageously, the fluid supplying passage means further includes a rear subsidiary fluid supplying recess formed in the rear inner wall surface portion of the heat generating chamber. The rear subsidiary fluid supplying recess is preferably formed as a curved recess arranged adjacent to the communicating gap and extending circumferentially in a direction corresponding to a rotating direction of the rotor element.

Preferably, the fluid supplying passage means further includes a front subsidiary fluid supplying recess formed in a front inner wall surface portion of the heat generating chamber. The front subsidiary fluid supplying recess is preferably arranged adjacent to the communicating gap and extending circumferentially in a direction corresponding to the rotating direction of the rotor element.

Preferably, the above-mentioned front subsidiary fluid supplying recess is formed as a curved recess having first and second circumferentially opposite portions. The first portion introduces therein the viscous fluid from the communicating gap in response to a rotation of said rotor element, and the second portion distributes the viscous fluid from the curved recess into an outer region of the first fluid filled gap of the heat generating chamber.

Advantageously, the curved recess of the front subsidiary fluid supplying recess has an edge therearound which include a front edge portion and a trailing edge portion with respect to the rotating direction of the rotor element. The front edge portion should preferably be chamfered.

Preferably, the fluid withdrawing passage means includes a front fluid withdrawing recess formed in the front inner wall surface portion and a rear fluid withdrawing recess formed in the rear inner wall surface portion of the heat generating chamber. The front fluid withdrawing recess should preferably be formed as a linear recess inclined from a radial line in a direction corresponding to the rotating direction of the rotor element, and the rear fluid withdrawing recess should preferably be formed as a linear recess inclined from a radial line in a direction reverse to the rotating direction of the rotor element. The front and rear fluid withdrawing recesses should fluidly communicate with the communicating gap.

Preferably, the housing assembly includes outer front and rear housing bodies axially combined together, and inner front and rear plate members axially combined together and accommodated in the axially combined outer front and rear housing bodies. Then, the inner front and rear plate members define therein the heat generating chamber, and the communicating gap is formed by a portion of a cylindrical recess arranged in at least one of the front and rear plate members.

BRIEF DESCRIPTION OF THE DRAWINGS

The above, and other objects, features, and advantages of the present invention will be made more apparent from the ensuing description of the preferred embodiments of the present invention with reference to the accompanying drawings wherein.

Figure 1:
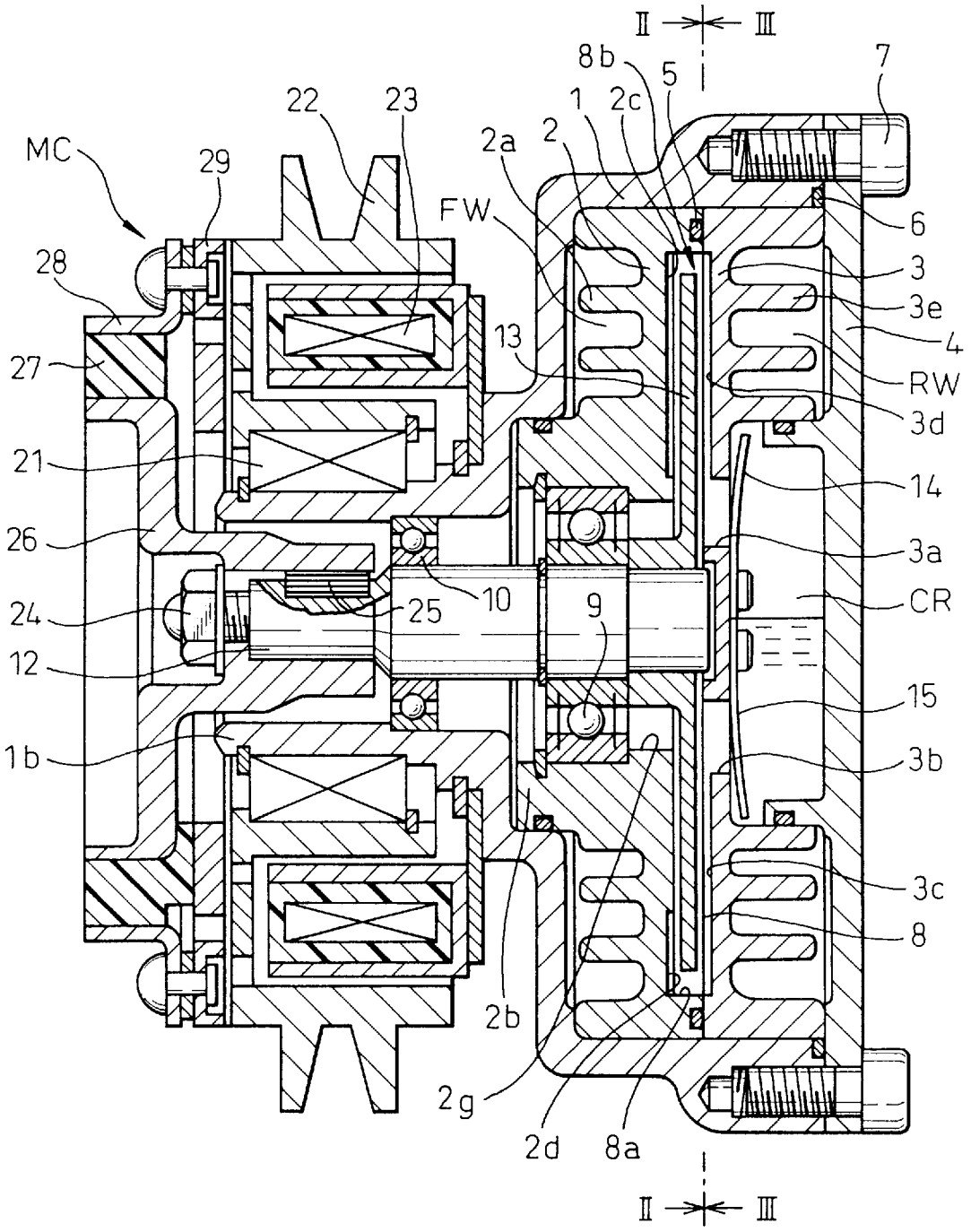
FIG. 1 is a cross-sectional view of a viscous fluid type heat generator according to an embodiment of the present invention.
Figure 3:
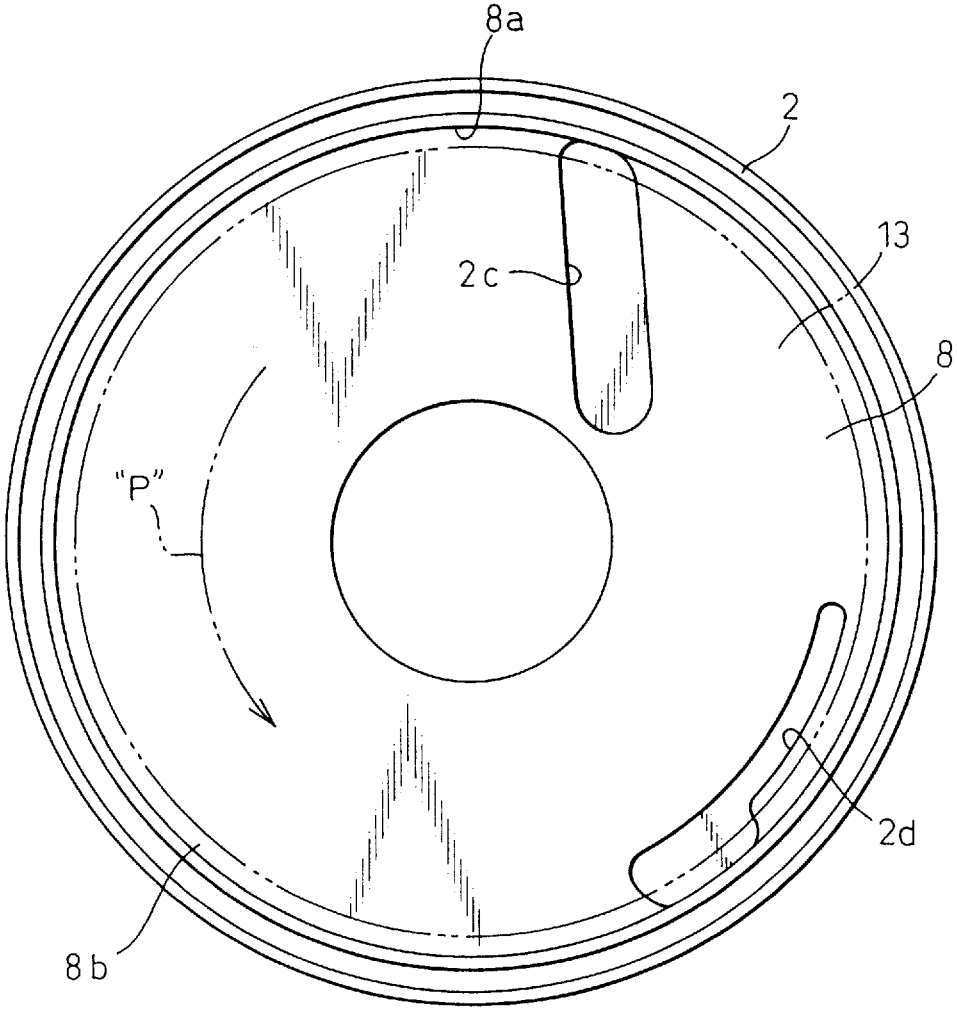
Figure 4:
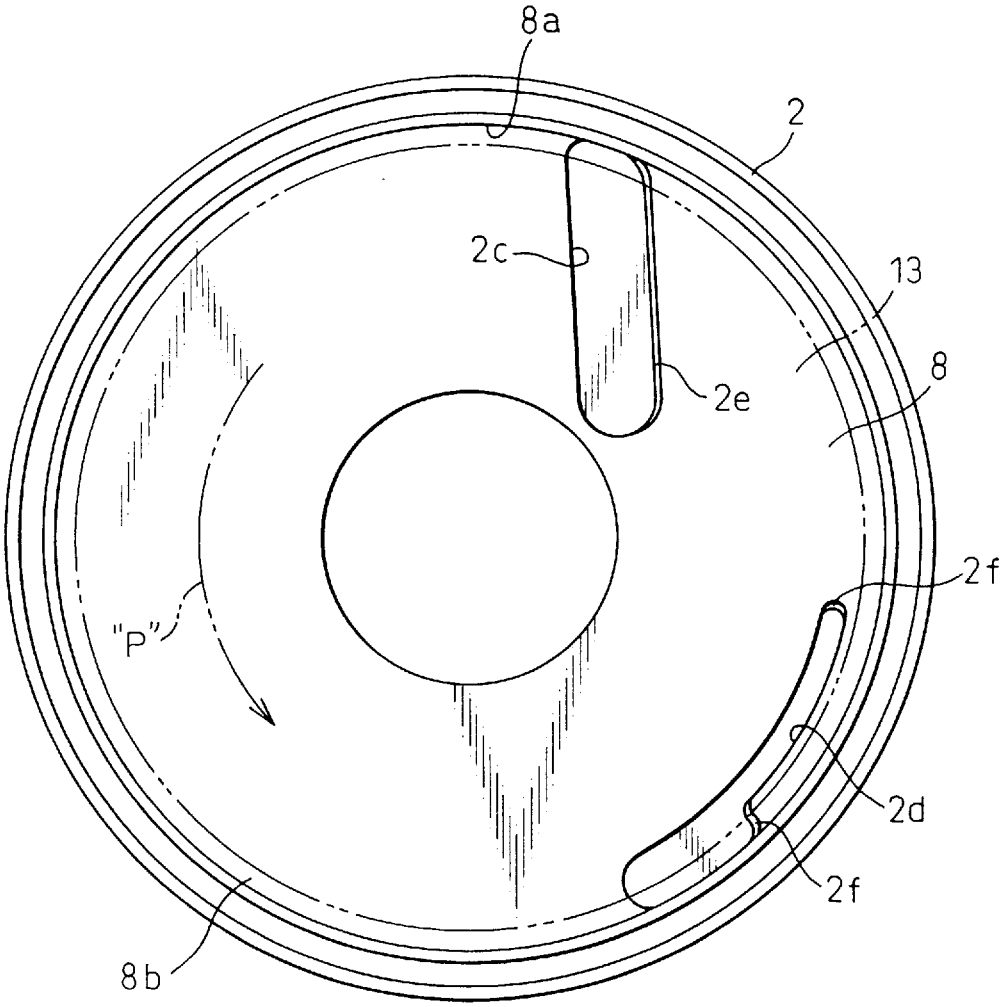
Figure 5:
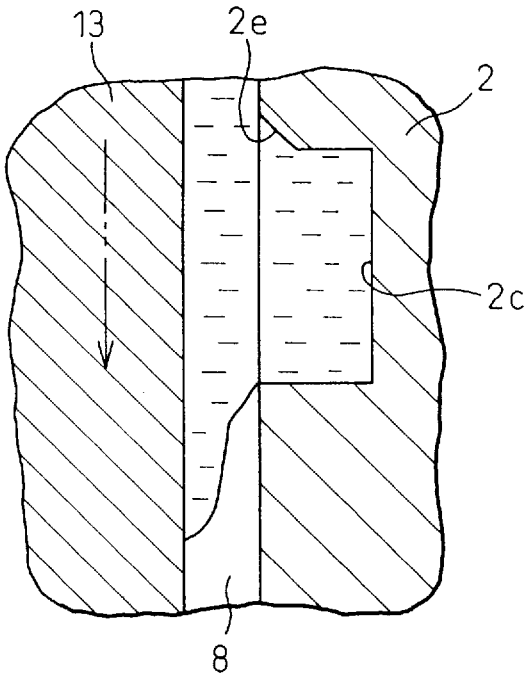
Figure 6:
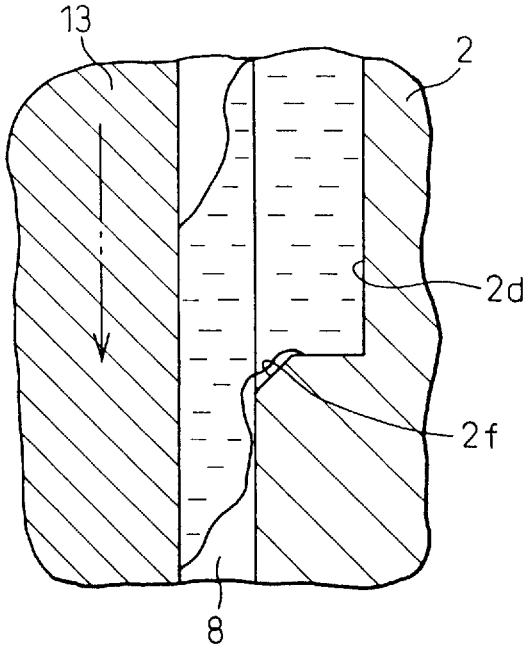
Figure 7:
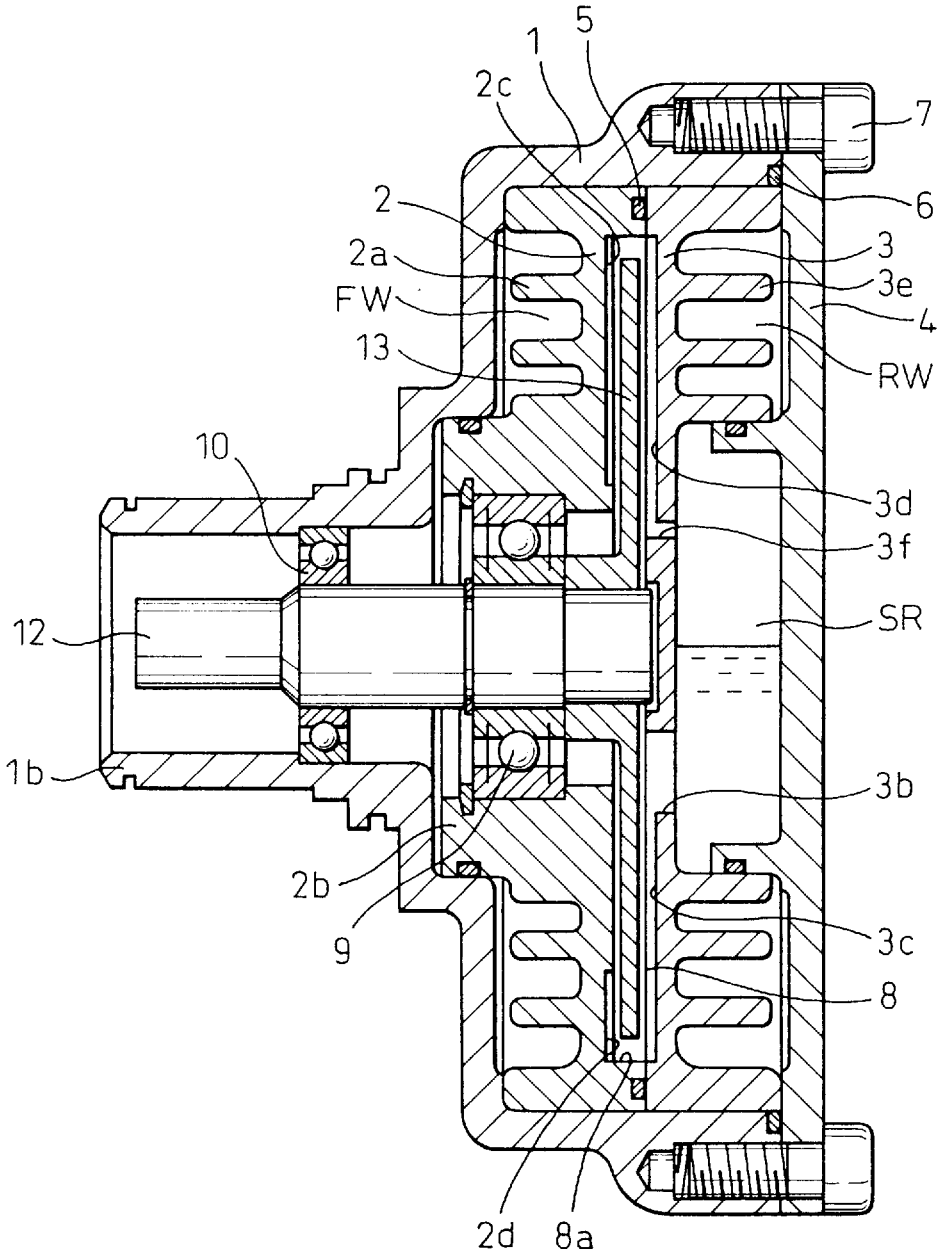

Fig, 2 is a cross-sectional view taken along the line II—II of FIG. 1, illustrating fluid supplying and fluid withdrawing recesses formed in the rear plate member of the heat generator;

FIG. 3 is a cross-sectional view taken along the line III—III of FIG. 1, illustrating fluid supplying and fluid withdrawing recesses formed in a front plate member of the heat generator;

FIG. 4 is a view similar to FIG. 3, illustrating modified fluid supplying and fluid withdrawing recesses formed in a front plate member capable of being accommodated in the heat generator of FIG. 1;

FIG. 5 is an enlarged cross-sectional and partial view of the front plate member of FIG. 4 and a rotor element cooperating with the front plate member, illustrating the operation of the fluid withdrawing recess;

FIG. 6 is an enlarged cross-sectional and partial view of the front plate member of FIG. 4 and a rotor element cooperating with the front plate member, illustrating the operation of the fluid supplying recess;

FIG. 7 is a cross-sectional view of a viscous fluid type heat generator according to a different embodiment of the present invention.

DESCRIPTION OF THE PREFERRED EMBODIMENTS

FIG. 1 illustrates a variable heat generating performance, viscous fluid type heat generator according to the first embodiment of the present invention, which is placed in a condition suitable for being mounted in a mounting region, e.g., an engine compartment, of a vehicle.

Referring to FIG. 1, the viscous fluid type heat generator according to the first embodiment includes a housing assembly provided with a front housing body 1, a front plate member 2, a rear plate member 3, and a rear housing body 4. The front plate member 2 and the rear plate member 3 are axially combined together via a sealing element made of an O-ring 5, to define a later-described heat generating chamber, and are accommodated in the interior of the front housing body 1, and the rear open end of the front housing body 1 is closed by the rear plate 4 fixed to the front housing body 1 by means of a plurality of screw bolts 7 via an O-ring 6.

The front plate element 2 is provided with a circular recess 8*a* formed in a rear end face thereof and cooperates with a front end face of the rear plate element 3 so as to define a heat generating chamber 8 in which heat generation, in a viscous fluid (typically a silicone oil) occurs when the viscous fluid is subjected to a shearing action by the rotation of a later-described rotor element 13.

The front plate member 2 is also provided with a plurality of circular fins 2*a* formed in a radially outer region of the front face thereof. The fins 2*a* project frontward and cooperate with the inner wall surface of the front housing 1 to define a front heat receiving chamber FW arranged adjacent to a front portion of the heat generating chamber 8 to receive therein a later-described heat exchanging liquid which receives heat from the front portion of the heat generating chamber 8.

The rear plate member 3 is provided with a plurality of circular fins 3*e* formed in a radially outer region of a rear face thereof. The circular fins 3*e* of the rear face of the rear plate member 3 project rearward and cooperate with an inner wall surface of the rear housing body 4 to define a rear heat receiving chamber RW arranged adjacent to a rear portion of the heat generating chamber 8 to receive therein the heat exchanging liquid which receives heat from the rear portion of the heat generating chamber 8.

The radially innermost circular fin 3*e* of the rear plate member 3 and the inner boss of the rear housing body 4 cooperate to define a sealed heat generation control chamber CR which fluidly communicates with a through-bore 3*a* (a fluid withdrawing passage), and a through-bore 3*b* (a fluid supplying passage) formed in the rear plate member 3.

The front housing body 1 is provided with a liquid inlet port (not shown) for heat exchanging liquid, and a liquid outlet port (not shown) for the heat exchanging liquid. The inlet and outlet ports are arranged adjacent to one another in an outer circumference of the front housing body 1, and fluidly connected to the front and rear heat receiving chambers FW and RW.

The front plate member 2 is further provided with a central boss portion 2*b* formed therein at a central portion thereof. The boss portion 2*b* is arranged so as to receive an anti-friction bearing 9 having therein a sealing element.

The front housing body 1 is provided with a central hollow boss portion 1*b* formed so as to frontwardly project and accommodate therein a grease-sealed anti-friction bearing 10. The anti-friction bearings 9 and 10 rotatably support an axial drive shaft 12. The axial drive shaft 12 is arranged substantially horizontally, and has an inner end located in a region between the front and rear plate members 2 and 3.

A solenoid clutch MC is mounted around the boss portion 1*b* of the front housing body 1. The solenoid clutch MC includes a pulley 22 rotatably mounted on the boss portion 1*b* via a anti-friction bearing 21, and a solenoid coil 23 arranged in an inner recess of the pulley 22. A hub member 26 is fixed to the drive shaft 12 by a screw bolt 24 thereadedly engaged in a frontmost end of the drive shaft 12 and a key 25 press-fitted between the hub 26 and an outer circumference of the drive shaft 12 at a position adjacent to the frontmost end of the drive shaft 12. The hub member 26 is also fixed to an armature 29 of the solenoid clutch MC via a rubber member 27 and a flange element 28. The pulley 22 is operatively connected to a vehicle engine via a belt member (not shown) and driven by the vehicle engine.

The drive shaft 12 supports thereon a rotor element 13 to rotate it within the afore-mentioned heat generating chamber 8. The rotor element 13 is formed as a flat disk-like element press-fitted on the inner end of the drive shaft 12, and having first and second flat faces (front and rear faces) facing front and rear surface portions of the inner wall surface of the heat generating chamber 8. The first and second flat faces of the rotor element 13 work as main faces to apply a shearing action to the viscous fluid, and causes heat generation by the viscous fluid. The circular recess 8*a* of the front plate member 2 for forming the heat generating chamber 8 has a predetermined inner diameter larger than an outer diameter of the rotor element 13. Accordingly, the heat generating chamber 8 has a generally central region arranged for rotatably receiving therein the rotor element 13, and an outer region located radially around the central region and extending between a cylindrical inner wall face of the circular recess 8*a* and an outer cylindrical face (third outer face) of the rotor element 13. Thus, the outer region of the heat generating chamber 8 defines a communicating gap 8*b* in the form of an annular gap extending around the third outer face of the rotor element 13. As best shown in FIG. 1, the communicating gap 8*b* is large in its size compared with each of front and rear fluid filled gaps defined between the first and second outer faces of the rotor element 13 and the front and rear wall surface portions of the inner wall surface of the heat generating chamber 8. Namely, the communicating gap 8*b* formed in the outer region of the heat generating chamber 8 provides a fluid communication between the front and rear fluid filled gaps across the outer circumference, i.e., the third outer face of the rotor element 13.

It should be understood that the front and rear fluid filled gaps of the heat generating chamber 8 are filled with the viscous fluid, i.e., a silicone oil, so as to generate a desired amount of heat due to the rotation of the rotor element 13.

Figure 2:
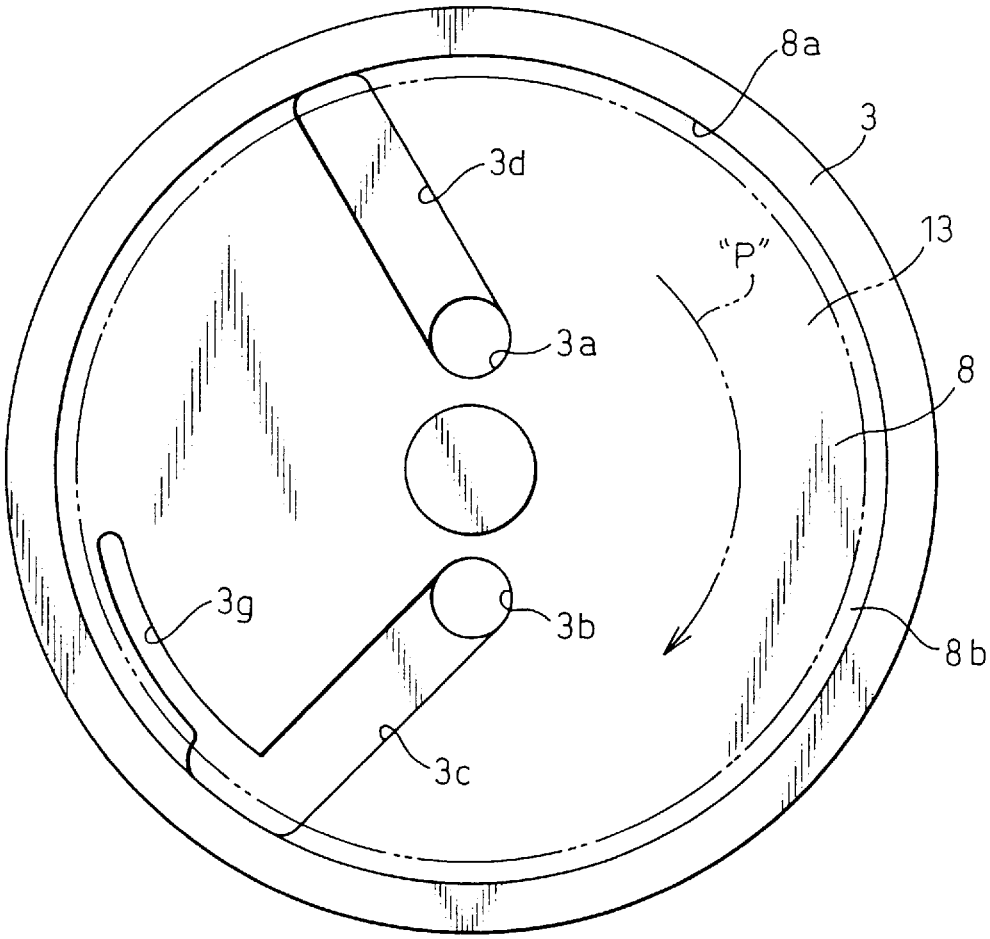

As shown in FIGS. 1 and 2, the rear plate member 3 is provided with a rear fluid withdrawing recess 3*d* formed in a front face thereof (a part of the inner wall surface of the heat generating chamber 8) opposite to the rear face having the fins 3*e*. The rear fluid withdrawing recess 3*d* is formed as a linear recess extending upwardly from a radially inner portion of the front face of the rear plate member 3 to a radially outer position adjacent to the cylindrical inner wall face of the heat generating chamber 8. The linear fluid withdrawing recess 3*d* is arranged to be inclined from a radial line in a direction reverse to a rotating direction designated by an arrow "P" of the rotor element 13, and an innermost end of the linear fluid withdrawing recess 3*d* is connected to the afore-mentioned fluid withdrawing passage 3*a* which is a through-bore formed in the rear plate member 3 at a position located above the center of the rear plate member 3 to communicate with the heat generation control chamber CR. An outermost end of the linear fluid withdrawing recess 3*d* extends beyond the outer circumference of the rotor element 13 and opens to the communicating gap 8*b* formed in the outer region of the heat generating chamber 8.

The rear plate member 3 is also provided with a rear fluid supplying recess 3*c* formed in the front inner surface thereof so as to extend linearly and downwardly from a radially central position of the front face of the plate member 3 to a radially outer position adjacent to the cylindrical inner wall face of the heat generating chamber 8. The rear fluid supplying recess 3*c* in the form of a linear recess is connected, at its outermost end, to a subsidiary fluid supplying recess 3*g* arranged in an outer marginal portion of the front face of the rear plate member 3. The subsidiary fluid supplying recess 3*g* extends in a circumferential direction corresponding to the rotating direction "P" of the rotor element 13 from the innermost end of the linear fluid supplying recess 3*c* to form a curved thin recess, and a connecting portion of the linear fluid supplying recess 3*c* and the subsidiary fluid supplying recess 3*g* is formed as an enlarged recess opening toward the communicating gap 8*b* of the heat generating chamber 8. The fluid supplying recess 3*c* is arranged to be inclined from a radial line of the rotor element 13 in a direction corresponding to the rotating direction "P" of the rotor element 13, and the outermost end of the fluid supplying recess 3*c* is located at a position beyond the outer circumference of the rotor element 13 and opens toward the communicating gap 8*b* of the heat generating chamber 8. An innermost end of the fluid supplying recess 3*c* is connected to the afore-mentioned fluid supplying passage 3*b* which is a through-bore formed in the central portion of the rear plate member 3 at a position below the center of the rear plate member 3 and communicates with the heat generation control chamber CR.

As shown in FIGS. 1 and 3, the front plate member 2 is provided with a front fluid withdrawing recess 2*c* formed in a rear surface (a part of the inner wall surface of the heat generating chamber 8) of the circular recess 8*a* of the front plate member 2. The front fluid withdrawing recess 2*c* is formed as a linear recess extending radially and upwardly from a central portion of the rear-surface to a position adjacent to the cylindrical inner wall surface of the heat generating chamber 8. As is obvious from the illustration of FIG. 3, the linear fluid withdrawing recess 2*c* is inclined from a radial line of the circular recess 8*a* in a direction corresponding to the rotating direction "P" of the rotor element 13, and an outermost end of the linear fluid withdrawing recess 2*c* is located at a position beyond the circumference of the rotor element 13 and adjacent to the cylindrical wall surface of the heat generating chamber 8. Thus, the outermost end of the linear fluid withdrawing recess 2*c* opens toward the communicating gap 8*b* of the outer region of the heat generating chamber 8.

The front plate member 2 is also provided with a front subsidiary fluid supplying recess 2*d* formed as a curved recess extending in a circumferential direction of the rear of the circular recess 8*a* of the front plate member 2. The front subsidiary fluid supplying recess 2*d* has a radially outer portion thereof which is located radially outside the circumference of the rotor element 13 and opens toward the communicating gap 8*b* of the heat generating chamber 8.

The fluid filled gaps between the first and second outer faces of the rotor element 13 and the inner wall surface of the heat generating chamber 8, the communicating gap between the outer circumference (the third outer face) of the rotor element 13 and the cylindrical inner wall surface of the heat generating chamber 8, and the heat generation control chamber CR (FIG. 1) are filled with the viscous fluid, i.e., a silicone oil, and a small amount of air which is unavoidably contained in the silicone oil. It should be understood that the heat generation control chamber CR has a volume capable of sufficiently receiving a predetermined amount of silicone oil of which the volume is larger than the entire capacity of the fluid filling gaps in the heat generating chamber 8. Since the heat generation control chamber CR fluidly communicates with the heat generating chamber 8 either to withdraw the silicone oil from the heat generating chamber 8 or to supply the silicone oil into the heat generating chamber 8 as required, an accurate and strict control of the silicone oil (the viscous fluid) initially supplied into the viscous fluid type heat generator is not needed. Thus, the assembly of the viscous fluid type heat generator can be made easy.

In the described first embodiment of FIGS. 1 through 3, the front side of the heat generating chamber 8 with respect to the rotor element 13 opens at an inner bore 2*g* of the boss portion 2*b* of the front plate member 2. However, the rear side of the heat generating chamber 8 with respect to the rotor element 13 opens at the fluid withdrawing passage 3*a* and the fluid supplying passage 3*b*. Therefore, an effective area for the heat generation on the front side of the heat generating chamber 8 and that for the heat generation on the rear side of the heat generating chamber 8 are different from one another. Therefore, the amount of the silicone oil on the front side of the heat generating chamber 8 which is subjected to the shearing action by the first flat outer face of the rotating rotor element 13 is different from that of the silicone oil on the rear side of the heat generating chamber 8 which is subjected to the shearing action by the second flat outer face of the rotor element 13.

Further, in the first embodiment of FIGS. 1 through 3, one end of the fluid withdrawing passage 3*a* opening toward the heat generation control chamber CR is closed by a bimetal type flap valve means 14 which moves to open the open end of the fluid withdrawing passage 3*a* in response to an increase in the temperature of the silicone oil received in the heat generation control chamber CR. On the other hand, one end of the fluid supplying passage 3*b* opening toward the heat generation control chamber CR is closed by a bimetal type flap valve means 15 which moves to close the open end of the fluid supplying passage 3*b* in response to an increase in the temperature of the silicone oil. The two bimetal type flap valve means 14 and 15 are attached to the rear plate member 3 by a fixing means, e.g., screw bolts.

When the viscous fluid type heat generator incorporated in a vehicle heating system is driven by a vehicle engine via the solenoid clutch MC and the drive shaft 12, the rotor element 13 is rotated within the heat generating chamber 8. Thus, the silicone oil held in the first and second fluid filled gaps between the first and second flat faces of the rotor element 13 and the inner wall surface of the heat generating chamber 8 is subjected to the shearing action by the rotating rotor element 13. Thus, the silicone oil in the first fluid filling gap of the front side of the heat generating chamber 8 and in the second fluid filled gap of the rear side of the heat generating chamber 8 is circulatorily moved in a radial direction within the respective fluid filled gaps due to the known Weissenberg effect and a centrifugal force. Since all edges for the front fluid withdrawing recess 2*c*, the rear fluid withdrawing recess 3*d*, the fluid withdrawing passage 3*a*, the fluid supplying passage 3*b*, the rear subsidiary fluid supplying recess 3*g*, and the front subsidiary fluid supplying recess 2*d* are formed as acute right-angled edges, the shearing action applied to the silicone oil (the viscous fluid) during the rotation of the rotor element 13 is much strengthened so as to increase a heat generating efficiency. The heat generated by the silicone oil is transmitted to the heat exchanging liquid flowing through the front and rear heat receiving chambers FW and RW. Thus, the heat exchanging liquid carries the heat to the external vehicle heating system to apply heat to a desired heated area.

During the heat generating operation of the viscous fluid type heat generator, since the heat generating chamber 8 and the heat generation control chamber CR are formed as chambers sealed from the atmosphere, the silicone oil (the viscous fluid) does not come in contact with fresh air and moisture contained in the atmosphere. Therefore, the heat generating property of the silicone oil is neither degraded nor subjected to any adverse effect. Thus, a reliable heat generating operation of the viscous fluid type heat generator can be maintained over a long operating life of the heat generator.

Further, the viscous fluid type heat generator according to the first embodiment employs a flat-disc like rotor element 13 having first and second flat outer faces acting as main fluid shearing faces. Therefore, the entire axial length of the rotor element 13 can be short reducing the entire axial length of the heat generator, and accordingly, the mounting of the viscous fluid type heat generator in a small mounting space of a vehicle can be made easy.

Further, when the viscous fluid type heat generator is driven by the vehicle engine at a relatively low speed, the rotating speed of the drive shaft 12 and the rotor element 13 is rather low. Therefore, the silicone oil within the heat generating chamber 8 is subjected to the Weissenberg effect rather than the centrifugal force, and accordingly, the silicon oil is collected in the central region of the heat generating chamber 8. Specifically, the above-mentioned disc-like rotor element 13 and the cooperating small heat generating chamber 8 permit the silicon oil (the viscous fluid) to have a large fluid surface area lying in a flat plane extending perpendicularly to the central axis of the heat generating chamber 8, and therefore, the silicone oil can be surely subjected to the Weissenberg effect during the low speed rotation of the rotor element 13.

When the temperature of the silicone oil received in the heat generation control chamber CR is low, the heat generating application by the vehicle heating system is insufficient. Therefore, the flap valve means 14 acts so as to close the end of the fluid withdrawing passage 3*a* which opens toward the heat generation control chamber CR, and the flap valve means 15 acts so as to open the end of the fluid supplying passage which opens toward the heat generation control chamber CR. Therefore, withdrawal of the silicone oil from the first fluid filling gap, i.e., the front side of the heat generating chamber 8, the communicating gap 8*b* around the outer circumference of the rotor element 13, the second fluid filled gap, i.e., the rear side of the heat generating chamber 8 into the heat generation control chamber CR via the front fluid withdrawing recess 2*c*, the communicating gap 8*b*, the rear fluid withdrawing recess 3*d*, and the fluid withdrawing passage 3*a* does not occur. On the other hand, a part of the silicone oil is supplied from the heat generation control chamber CR into the rear side of the heat generating chamber 8 and the communicating gap 8*b* via the fluid supplying passage 3*b*, the rear fluid supplying recess 3*c*, and the rear subsidiary fluid supplying recess 3*g*. The silicone oil supplied into the radially outer region of the rear side of the heat generating chamber 8 carries out a circulatory movement within the second fluid filled gap within the heat generating chamber 8 due to the Weissenberg effect, and the centrifugal force acting thereon, and is gradually moved over the entire region in the rear side of the heat generating chamber 8 including the central region thereof. Further, the silicone oil supplied into the communicating gap 8*b* of the heat generating chamber 8 is similarly moved over the entire region of the front side (the first fluid filled gap) of the heat generating chamber 8.

Furthermore, after the opening of the fluid supplying passage 3*b* due to opening of the flap valve means 15, since the rear fluid supplying recess 3*c* is inclined with respect to the radial line, the silicone oil supplied from the heat generation control chamber CR into the outer region of the rear side of the heat generating chamber 8 and the communicating gap 8*b* is successfully guided by the rear fluid supplying recess 3*c*, and accordingly, the movement of the silicone fluid over the entire region of the rear side of the heat generating chamber 8 is quickly and smoothly achieved.

The curved rear subsidiary fluid supplying recess 3*g* extending in the direction corresponding to the rotating direction "P" of the rotor element 13 contributes to application of a part of a suction force caused by the rotation of the rotor element 13 to the silicone oil held in the outer region of the heat generating chamber 8. Thus, the silicone oil is quickly and sufficiently distributed to a region surrounding the outer circumference of the rotor element 13. As a result, the silicone oil in the communicating gap between the cylindrical inner wall face of the heat generating chamber 8 and the outer circumference of the rotor element 13 can effectively generate heat so as to increase the entire amount of heat generation (an increase in the heat generating performance occurs). Thus, the heat application by the vehicle heating system is increased.

When the drive shaft 12 and the rotor element 13 are continuously rotated by the vehicle engine at a relatively high speed, the silicone oil within the heat generating chamber 8 is moved toward and collected in the outer region of the heat generating chamber 8 due to the centrifugal force acting thereon rather than to the Weissenberg effect on the silicon oil per se.

At this stage, when the temperature of the silicone oil within the heat generation control chamber CR is increased, the heat application to the heated area by the vehicle heating system is excessive. Thus, the flap valve means 14 acts so as to open the fluid withdrawing passage 3*a* in response to the temperature increase of the silicone oil, and the flap valve means 15 acts so as to close the fluid supplying passage 3*b*. Therefore, the silicone oil held in the front side of the heat generating chamber 8 is moved therefrom into the communicating gap 8*b* via the front fluid withdrawing recess 2*c*. Further, the silicone oil held in the communicating gap 8*b* and the rear side of the heat generating chamber 8 is withdrawn therefrom into the heat generation control chamber CR via the rear fluid withdrawing recess 3*d* and the fluid withdrawing passage 3*a*. Since the front and rear fluid withdrawing recesses 2*c* and 3*d* are inclined, respectively, with respect to a radial line of the heat generating chamber 8, the withdrawal of the silicone oil into the heat generation control chamber CR is effectively promoted by the guide of the two recesses 2*c* and 3*d*.

On the other hand, the supply of the silicone oil from the heat generation control chamber CR into the front and rear sides of the heat generating chamber 8 and the communicating gap 8*b* via the fluid supplying passage 3*b*, the rear fluid supplying recess 3*c*, the rear subsidiary fluid supplying recess 3*g*, the communicating gap 8*b*, and the front subsidiary fluid supplying recess 2*d* does not occur. Therefore, the heat generation in the first and second fluid filled gaps between the first and second outer faces of the rotor element and in the communicating gap between the cylindrical inner surface of the heat generating chamber 8 and the outer circumference of the rotor element 13 is reduced (reduction in the heat generating performance occurs), and the application of heat by the vehicle heating system to the desired heated area is reduced.

In the viscous fluid type heat generator of the first embodiment, the silicone oil held by the front and rear sides of the heat generating chamber 8 are fluidly communicated by the silicone oil in the communicating gap 8*b* across the rotor element 13, and accordingly, the silicone oil can be promoted to flow from the front to rear side of the heat generating chamber 8 and vice versa. Since the communicating gap 8*b* is arranged in the outer region of the heat generating chamber 8 in which an amount of the silicone oil moving circulatorily is large compared with that of the silicone oil moving circulatorily in the radially inner region of the heat generating chamber 8, and since a pressure level in the communicating gap 8*b* is larger than that in the radially inner region of the heat generating chamber 8, the flow of the silicone oil from the front to rear side of the heat generating chamber 8 and vice versa is increased when the centrifugal force acting on the silicone oil is large due to a high speed rotation of the drive shaft 12. The flow of the silicone oil from the front to rear side of the heat generating chamber 8, and vice versa, via the communicating gap 8*b* can cause replacement of the silicone oil between the front and rear sides of the heat generating chamber 8. This is very effective for preventing an occurrence of unequal degradation of the heat generating property of the silicone oil (the viscous fluid) even when the amount of the silicone oil in the front side of the heat generating chamber 8 is different from that of the silicone oil in the rear side of the heat generating chamber 8. Accordingly, the viscous fluid type heat generator can exhibit a stable heat generating efficiency over a long operating life of the heat generator, and a reliable heat generating performance of the viscous fluid type heat generator can be ensured.

It should be understood that in the viscous fluid type heat generator of the first embodiment, the starting and stopping of the withdrawal of the silicone oil from the heat generating chamber 8 into the heat generation control chamber CR is controlled by the thermally sensitive flap valve means 14 which opens and closes the fluid withdrawing passage 3*a*. Further, the starting and stopping of the supply of the silicone oil from the heat generation control chamber CR into the heat generating chamber 8 is controlled by the thermally sensitive flap valve means 15 which opens and closes the fluid supplying passage 3*b*. Therefore, the viscous fluid type heat generator according to the first embodiment of the present invention can be a viscous fluid type heat generator having a variable heat generating performance. Thus, when the heat generating performance of the heat generator is reduced, the silicone oil within the heat generating chamber 8 can be prevented from having an excessively high temperature even if the rotating speed of the drive shaft 12 and the rotor element 13 is kept high. Thus, the degradation of the silicone oil can be prevented.

Further, in the viscous fluid type heat generator of the first embodiment, the heat generation control chamber CR can receive the silicone oil of which the amount is larger than the entire volume of the fluid filling and communicating gaps of the heat generating chamber 8, the silicone oil subjected to the shearing action within the heat generating chamber 8 by the rotor element 13 can be replaced with the silicone oil supplied from the heat generation control chamber CR, and is not limited to only the specified amount of silicone oil. Therefore, the degradation of the heat generating property of the silicone oil does not quickly occur. Namely, a reliable heat generating property of the silicone oil can be maintained over a long operating life of the viscous fluid type heat generator. Thus, the viscous fluid type heat generator of the first embodiment of the present invention can exhibit a sufficient heat generating ability while maintaining an isolated condition of the heat generating and heat generation control chambers 8 and CR.

FIGS. 4 through 6 illustrate a different arrangement of the front fluid withdrawing recess and front subsidiary fluid supplying recess of the front plate member 2. Namely, the front fluid withdrawing recess 2*c* and the front subsidiary fluid supplying recess 2*d* are modified so that one edge of the recess 2*c*, i.e., a trailing edge of the recess 2*c* with respect to the rotating direction "P" of the rotor element 13 is formed as a chamfered edge 2*e*. Similarly, a front or leading edge of the recess 2*d* with respect to the rotating direction "P" of the rotor element 13 is formed as a chamfered edge 2*f*.

In a viscous fluid type heat generator accommodating therein the front plate member 2 having the above-mentioned front fluid withdrawing recess 2*c* and front subsidiary fluid supplying recess 2*d*, the silicone oil held in the front side of the heat generating chamber 8 is subjected to a scraping action by the acute right-angled edge of the rotor element 13 as shown in FIG. 5. However, the silicone oil is simultaneously guided by the chamfered edge 2*e* of the front fluid withdrawing recess 2*c* so as to smoothly enter the recess 2*c* and, in turn, the heat generation control chamber CR. Further, as shown in FIG. 6, the silicone oil is smoothly moved from the front subsidiary fluid supplying recess 2*d* into the heat generating chamber 8 by the guiding of the chamfered edge 2*f* of the recess 2*d*. The other construction and operation of the viscous fluid type heat generator of FIGS. 5 and 6 is the same as those of the heat generator of the first embodiment.

FIG. 7 illustrates a viscous fluid type heat generator according to a different embodiment of the present invention.

The viscous fluid type heat generator of the present embodiment is different from the heat generator of the first embodiment of FIGS. 1 through 3 in that a small fluid withdrawing passage 3*f* compared with the fluid withdrawing passage 3*a* (see FIG. 1) is bored in the rear plate member 3. Thus, the withdrawal of the viscous fluid from the heat generating chamber 8 into the fluid receiving chamber SR via the fluid withdrawing passage 3*f* is restricted compared with the heat generator of the first embodiment. Further, the heat generator of the present embodiment is not provided with flap type valve means 14 and 15 opening and closing the fluid withdrawing passage 3*f* and the fluid supplying passage 3*b*. The remaining construction of the viscous fluid type heat generator of the present embodiment is the same as that of the heat generator of the first embodiment.

In the viscous fluid type heat generator of the present embodiment, since no flap valve means is arranged in the fluid receiving chamber SR, replacement of the silicone oil in the heat generating chamber 8 with the silicone oil in the fluid receiving chamber SR constantly occurs during the rotation of the drive shaft 12 and the rotor element 13. The other operation of the heat generator of the present embodiment is the same as that of the viscous fluid type heat generator of the first embodiment.

From the foregoing description of the preferred embodiments of the present invention, it will be understood that the viscous fluid type heat generator according to the present invention can exhibit a reliable and effective heat generating performance over a long operating life by preventing the viscous fluid from being unequally degraded in the front and rear sides of the heat generating chamber with respect to the rotor element rotating within the heat generating chamber.

Many and various modifications to the internal construction of the viscous fluid type heat generator will occur to a person skilled in the art without departing from the scope and spirit of the invention as claimed in the accompanying claims.

We claim:

1. A viscous fluid type heat generator comprising:

a housing assembly defining therein a heat generating chamber in which heat is generated, and a heat receiving chamber arranged adjacent to said heat generating chamber to permit a heat exchanging fluid to circulate therethrough to thereby receive heat from said heat generating chamber, said heat generating chamber having an inner wall surface thereof;

a drive shaft supported by said housing assembly, via bearing means, to be rotatable about an axis of rotation thereof, said drive shaft being operatively connected to an external rotation-drive source;

a rotor element mounted to be rotationally driven by said drive shaft for rotation together therewith about the axis of rotation of said drive shaft within said heat generating chamber, said rotor element having first and second outer faces axially opposite to one another and a third outer face extending between said first and second outer faces, said first and second outer faces axially confronting said inner wall surface of said heat generating chamber via first and second predetermined fluid filled gaps;

a viscous fluid, filling at least said first and second predetermined fluid filled gaps between said inner wall surface of said heat generating chamber and said first and second outer faces of said rotor element, for heat generation during the rotation of said rotor element, wherein said heat generating chamber of said housing assembly is formed as a chamber, with a predetermined volume, sealed from the atmosphere and having a central region receiving therein said rotor element and an outer region extending around said central region to define, between said third outer face of said rotor element and said inner wall face of said heat generating chamber, a communicating gap which is larger than each of said predetermined first and second fluid filled gaps and provides a fluid communication between said predetermined first and second fluid filled gaps defined by said first and second outer faces of said rotor element and said inner wall surface of said heat generating chamber.

2. A viscous fluid type heat generator according to claim 1, wherein said housing assembly further defines a fluid receiving chamber sealed against the atmosphere and fluidly communicating with said heat generating chamber via a fluid withdrawing passage means, arranged at a radially inner portion above a center of said inner wall surface of a rear wall of said heat generating chamber and a fluid supplying passage means, said sealed fluid receiving chamber having a capacity suitable for receiving a predetermined volume of viscous fluid which is larger than an entire volume of said predetermined gap defined by said first and second outer faces of said rotor element and said inner wall surfaces of said heat generating chamber.

3. A viscous fluid type heat generator according to claim 2, wherein said fluid withdrawing passage means and said fluid supplying passage means are arranged to provide a constant fluid communication between said heat generating chamber and said fluid receiving chamber.

4. A viscous fluid type heat generator according to claim 2, wherein at least one of said fluid withdrawing passage means and said fluid supplying passage means is provided with an open end opened and closed by a valve means.

5. A viscous fluid type heat generator according to claim 4, wherein said valve means comprises a thermosensitive flap valve means arranged in said fluid receiving chamber.

6. A viscous fluid type heat generator according to claim 2, wherein said inner wall surface of said heat generating chamber has a front inner wall surface portion confronting said first outer face of said rotor element, a rear inner wall surface portion confronting said second outer surface of said rotor element, and a cylindrical inner surface portion confronting said third outer surface portion of said rotor element, and wherein said fluid supplying passage means comprises a rear fluid supplying recess formed in said rear inner wall surface portion of said heat generating chamber, said rear fluid supplying recess being arranged to radially extend from a central region to an outer region of said rear inner wall surface portion to thereby communicate with said communicating gap in said heat generating chamber.

7. A viscous fluid type heat generator according to claim 6, wherein said rear fluid supplying recess of said fluid supplying passage means is formed in a linear recess having inner and outer ends, said inner end communicating with a fluid supplying passage bored in said central region of said rear inner wall surface portion and opening toward said fluid receiving chamber, said outer end being arranged in said communicating gap, said linear recess of said rear fluid supplying recess being provided with an inclined arrangement by which the viscous fluid is urged to be introduced in said predetermined second fluid filled gap and said communicating gap in response to the rotation of said rotor element.

8. A viscous fluid type heat generator according to claim 6, wherein said fluid supplying passage means further comprises a rear subsidiary fluid supplying recess formed in said rear inner wall surface portion of said heat generating chamber, said rear subsidiary fluid supplying recess being formed as a curved recess arranged adjacent to said communicating gap and extending circumferentially in a direction corresponding to a rotating direction of said rotor element.

9. A viscous fluid type heat generator according to claim 8, wherein said rear subsidiary fluid supplying recess is connected to said rear fluid supplying recess of said fluid supplying passage means.

10. A viscous fluid type heat generator according to claim 2, wherein said inner wall surface of said heat generating chamber has a front inner wall surface portion confronting said first outer face of said rotor element, a rear inner wall surface portion confronting said second outer surface of said rotor element, and a cylindrical inner surface portion confronting said third outer surface portion of said rotor element, and wherein said fluid supplying passage means further comprises a front subsidiary fluid supplying recess formed in said front inner wall surface portion of said heat generating chamber, said front subsidiary fluid supplying recess being arranged adjacent to said communicating gap and extending circumferentially in a direction corresponding to a rotating direction of said rotor element.

11. A viscous fluid type heat generator according to claim 10, wherein said front subsidiary fluid supplying recess is formed as a curved recess having first and second circumferentially opposite portions, said first portion introducing therein the viscous fluid from said communicating gap in response to a rotation of said rotor element, and said second portion distributing said viscous fluid from said curved recess into an outer region of said first fluid filled gap of said heat generating chamber.

12. A viscous fluid type heat generator according to claim 11, wherein said curved recess of said front subsidiary fluid supplying recess has an edge therearound which includes a front edge portion and a trailing edge portion with respect to the rotating direction of said rotor element, said front edge portion being chamfered.

13. A viscous fluid type heat generator according to claim 2, wherein said inner wall surface of said heat generating chamber has a front inner wall surface portion confronting said first outer face of said rotor element, a rear inner wall surface portion confronting said second outer surface of said rotor element, and a cylindrical inner surface portion confronting said third outer surface portion of said rotor element, and wherein said fluid withdrawing passage means comprises at least one fluid withdrawing recess formed in at least one of said front and rear inner wall surface portions of said heat generating chamber, said fluid withdrawing recess being arranged to radially extend from a central region to an outer region of said one of said front and rear inner wall surface portions to thereby communicate with said communicating gap.

14. A viscous fluid type heat generator according to claim 13, wherein said fluid withdrawing passage means comprises a front fluid withdrawing recess formed in said front inner wall surface portion and a rear fluid withdrawing recess formed in said rear inner wall surface portion of said heat generating chamber, said front fluid withdrawing recess being formed as a linear recess inclined from a radial line in a direction corresponding to a rotating direction of said rotor element, and said rear fluid withdrawing recess being formed as a linear recess inclined from a radial line in a direction reverse to the rotating direction of said rotor element, said front and rear fluid withdrawing recesses fluidly communicating with said communicating gap.

15. A viscous fluid type heat generator according to claim 1, wherein said housing assembly comprises outer front and rear housing bodies axially combined together, and inner front and rear plate members axially combined together and accommodated in said axially combined outer front and rear housing bodies, said inner front and rear plate members defining therein said heat generating chamber, and wherein said communicating gap is formed by a portion of a cylindrical recess arranged in at least one of said front and rear plate members.

16. A viscous fluid type heat generator according to claim 15, wherein said cylindrical recess has an inner diameter larger than an outer diameter of said rotor element, and said portion of said cylindrical recess is an annular portion extending around said rotor element.

* * * * *

UNITED STATES PATENT AND TRADEMARK OFFICE

CERTIFICATE OF CORRECTION

PATENT NO. : 5,875,742

DATED : March 2, 1999

INVENTOR(S) : Takahiro Moroi et al.

It is certified that error appears in the above-identified patent and that said Letters Patent is hereby corrected as shown below:

On the title page,:

In item [73] the name of the Assignee should read --Kabushiki Kaisha Toyoda Jidoshokki Seisakusho, Kariya, Japan--

Signed and Sealed this

Twenty-seventh Day of July, 1999

*Attest:*

*Attesting Officer*

Q. TODD DICKINSON

*Acting Commissioner of Patents and Trademarks*